United States Patent [19]

Brittain

[11] Patent Number: 4,820,144

[45] Date of Patent: Apr. 11, 1989

[54] TILE MAKING MACHINES

[75] Inventor: David R. Brittain, Crowborough, United Kingdom

[73] Assignee: Marley Tile A.G., Zurich, Switzerland

[21] Appl. No.: 932,308

[22] Filed: Nov. 19, 1986

[30] Foreign Application Priority Data

Nov. 19, 1985 [GB] United Kingdom ..... 8528397

[51] Int. Cl.[4] ..... B28B 5/04

[52] U.S. Cl. ..... 425/183; 104/2; 104/3; 198/735; 425/253

[58] Field of Search ..... 198/735; 104/2, 3, 7; 211/175, 207; 425/253, 254, 183, 195

[56] References Cited

U.S. PATENT DOCUMENTS

| | | | |
|---|---|---|---|
| 297,917 | 4/1984 | Chambers | 425/377 |
| 1,837,996 | 1/1965 | Queinnec | 425/317 |
| 3,165,807 | 1/1965 | Berliner et al. | 425/377 |
| 3,257,701 | 6/1966 | Lang | 425/253 |
| 4,386,694 | 6/1983 | Van Heel et al. | 425/253 |
| 4,661,054 | 4/1987 | Oberoi et al. | 425/254 |

FOREIGN PATENT DOCUMENTS 1955089 2/1978 Fed. Rep. of Germany .

*Primary Examiner*—Willard E. Hoag
*Attorney, Agent, or Firm*—Bacon & Thomas

[57] ABSTRACT

A tile making machine in which tiles are formed on pallets conveyed in succession through the machine has laterally spaced, longitudinally extending tracks for supporting the pallets. The pallets can be supported at different heights by the provision of a fixed track to provide a relatively low track level and another track removably supported by the fixed track to provide a higher track level. The higher track level enables pallets for tiles of flatter profile to be conveyed without requiring the pallet to have an excessive depth.

9 Claims, 1 Drawing Sheet

TILE MAKING MACHINES

FIELD OF THE INVENTION

This invention relates to tile making machines in which tiles are formed, normally by extrusion, on pallets.

BACKGROUND OF THE INVENTION

It is known to provide a tile making machine in which an end-to-end succession of pallets are propelled through a tile extrusion device by using driven pawls which engage and push an appropriate part of a pallet. The pallets are supported and guided on fixed tracks extending through the propulsion unit and extrusion device. The production of tiles of differing profile on the same machine requires that the pallets on which the tiles are extruded have certain common reference points to coincide with the level of the fixed supporting tracks. The tracks are fixed relatively low so that pallets for tiles of a deep profile can be accommodated, but this means that a pallet for a flat tile has to be designed with a very deep section. Pallets of deep section occupy more space than shallow pallets when vertically racked for transport into a curing chamber, requiring a larger curing volume for a given number of tiles. Pallets are required in large numbers in a tile production line and it is therefore desirable for reasons of expense to reduce the size of the pallets where possible.

SUMMARY OF THE INVENTION

Thus the invention provides a tile making machine in which tiles are formed on pallets conveyed in succession through the machine, including means for supporting the pallets, the support means providing a track level adjustable in height to accommodate pallets of different depth.

With such an arrangement, pallets for tiles of different profile can be conveyed simply by changing the track level of the machine, so that a pallet for a flat tile, for example, need not be excessively deep and can be reduced to a size necessary to withstand the extrusion pressures only.

Clearly there are many possible ways in which a height adjustable track level can be obtained. For example, height adjustment of a track along which the pallets are to be conveyed may be effected mechanically, hydraulically or pneumatically. However, in a preferred embodiment, the machine includes a fixed first track to provide a relatively low track level, and a second track removably arranged above said first track to provide a higher track level. With such an arrangement, if the low track level has been in use and it is desired to raise the level, it is a simple matter to secure the second track in position without any need to remove the first track. In fact, the arrangement may be such that the first track, being secured in position, provides lateral and longitudinal support to the second track. suitable bridging means may be provided to span the first track and support the second track, and such bridging means may itself be of adjustable height so as to provide a variable level of the second track.

The support means for pallets will generally include a plurality of laterally spaced, longitudinally extending tracks each corresponding to a particular lateral reference point on the pallets to be conveyed. In order to convey pallets of different design, it may only be necessary to adjust the height of the track level corresponding to just one of these reference points, but preferably more than one such track level is adjustable in height. Preferably, the machine includes three or more laterally spaced tracks for supporting the pallets, the two outer tracks being at a fixed level and the or each inner track being arranged to provide a track level of adjustable height. In a preferred embodiment, four laterally spaced tracks are provided.

BRIEF DESCRIPTION OF THE DRAWINGS

A specific embodiment of the invention will now be described, by way of example only, with reference to the accompanying drawings, in which.

DESCRIPTION OF THE PREFERRED EMBODIMENTS

Figure 1:
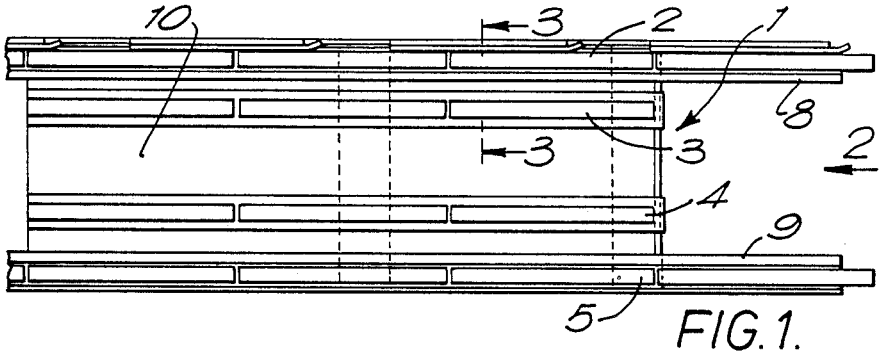
FIG. 1 is a plan view of pallet support means of a tile making machine.
Figure 2:
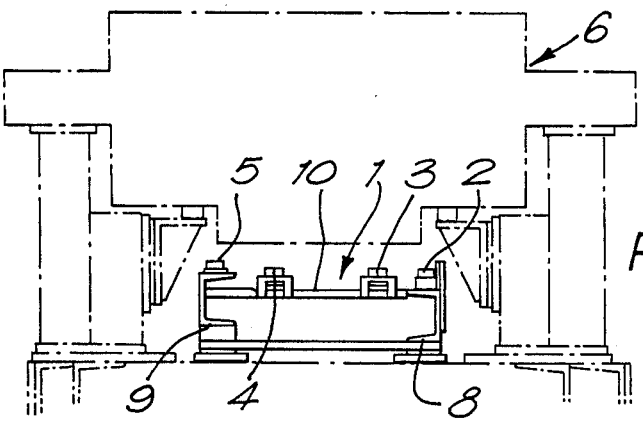
FIG. 2 is an end view of the support means in the direction of arrow "2" in FIG. 1.
Figure 3:
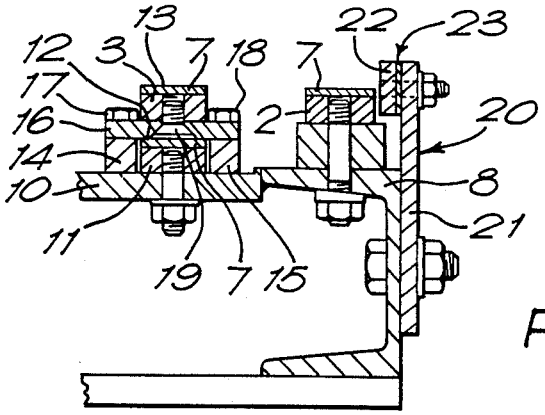
FIG. 3 is an enlarged cross-sectional view on 3—3 of FIG. 1.

Referring to FIGS. 1 and 2 the support means 1 for the pallets (not shown) comprises four tracks 2, 3, 4, 5 extending longitudinally from a pallet propulsion unit 6 through a tile extrusion device (not shown) of the machine. Each of these tracks is provided with a wear-resistant strip 7, as seen in FIG. 3 which shows tracks 2 and 3. Two channel sections 8 and 9 are rigidly secured to the machine and extend longitudinally thereof to provide support for the tracks. The outer tracks 2 and 5 are disposed above the channel sections and are bolted thereto (see FIG. 3). A hortizontal plate member 10 is welded to the channel sections and carries the inner tracks 3 and 4.

FIG. 3 shows how a height adjustable track level is provided by the support means 1 in this embodiment. A track 11 is conventionally bolted directly to the plate member 10 and extends longitudinally. This track 11 can provide a relatively low track level 12 when tiles of deep profile are to be formed, requiring deep pallets. However, as illustrated, means are provided which bridge the track 11 so that another track i.e. track 3 can be secured thereabove, so as to provide a higher track level 13 for pallets used in forming tiles of a flatter profile. The bridge means comprises a pair of legs 14 and 15 disposed one on each side of the track 11 and a cross-member 16 bolted to these legs by bolts 17 and 18. The bridge means may itself provide height adjustment if desired. Countersunk bolts 19 secure the track 3 to the cross-member 16.

Lateral guide means 20 are provided on one side of the support means 1, comprising a guide support plate 21 to which is bolted a lateral guide member 22 for the pallets. A shim 23 intervenes between the support plate 21 and the guide member 22.

Thus in this embodiment the support means 1 can provide a track level which is adjustable in height simply by placing one track on top of another. Of course a variable track level can be provided in other ways such as by height adjustment of a single track, e.g. mechanically by using threaded track support members which may be turned to give the required up or down movement. Such an arrangement may be electrically or manually operated. Another possibility would be to use removable spacer elements or alternatively, hydraulic or pneumatic height adjustment could be effected.

Modifications to the specific embodiments and to any broad aspects thereof referred to or suggested herein may be apparent to those skilled in the art and the disclosure hereof is intended to encompass any such modifications.

I claim:

1. In a tile making machine in which tiles are formed in pallets conveyed in succession through the machine, the improvement including means for supporting the pallets comprising track means adjustable in height to accommodate pallets of different depth, said track means including a first fixed track arranged to provide a relatively low track level, and a second track removably arranged above said first track to provide a higher track level.

2. A machine as claimed in claim 1, comprising bridging means arranged to span the first track and to support the second track, the bridging means being of adjustable height to provide a variable level of the second track.

3. A machine as claimed in claim 1, wherein the support means for pallets includes a plurality of laterally spaced, longitudinally extending tracks each corresponding to a particular lateral reference point on the pallets to be conveyed.

4. A machine as claimed in claim 3, said longitudinally extending tracks including four laterally spaced tracks, the two outer tracks being at a fixed level and the two inner tracks comprising said track means adjustable in height.

5. In a tile making machine in which tiles are formed on pallets conveyed in succession through the machine, including a tile extrusion device and track means for supporting the pallets as they are conveyed to and through the tile extrusion device, the improvement comprising: said track means being arranged to provide a track level adjustable in height between a first level to support pallets of a first depth during their conveyance to and through the tile extrusion device, and a second level to support pallets of a second depth during their conveyance to and through the tile extrusion device, said second level being higher than said first level and said second depth being less than said first depth, whereby pallets of said differing first and second depths may be supported at the appropriately adjusted level during their conveyance to and through the tile extrusion device, so that the machine is operable to form tiles which are either relatively deep or flat, said deep tiles being formed using said pallets of said first depth and said flat tiles being formed using said pallets of said lesser second depth, such that when said flat tiles are formed in a plurality of said pallets of said second depth the plurality of pallets occupy less space when vertically racked than the same plurality of pallets of said first depth, thereby saving on the size of and the space occupied by said pallets for forming flat tiles.

6. A machine as claimed in claim 5, wherein said track means includes a fixed first track to provide a relatively low track level, and a second track removably arranged above said first track to provide a higher track level.

7. A machine as claimed in claim 6, including bridging means arranged to span the first track and to support the second track, the bridging means being of adjustable height to provide a variable level of the second track.

8. A machine as claimed in claim 5, wherein the support means for pallets includes a plurality of laterally spaced, longitudinally extending tracks each corresponding to a particular lateral reference point on the pallets to be conveyed.

9. A machine as claimed in claim 8, including four laterally spaced tracks, the two outer tracks being at a fixed level and the two inner tracks being arranged to provide a track level of adjustable height.

* * * * *